US011701665B2

(12) United States Patent
Hedlund et al.

(10) Patent No.: US 11,701,665 B2
(45) Date of Patent: Jul. 18, 2023

(54) REFINER FOR REFINING LIGNOCELLULOSIC MATERIAL AND REFINING SEGMENTS FOR SUCH A REFINER

(71) Applicant: VALMET AB, Sundsvall (SE)

(72) Inventors: Christer Hedlund, Katrineholm (SE); Karl Lönngren, Skanör (SE); Mikael Lundfors, Hässelby (SE)

(73) Assignee: VALMET AB, Sundsvall (SE)

( * ) Notice: Subject to any disclaimer, the term of this patent is extended or adjusted under 35 U.S.C. 154(b) by 253 days.

(21) Appl. No.: 17/021,075

(22) Filed: Sep. 15, 2020

(65) Prior Publication Data

US 2021/0146371 A1 May 20, 2021

(30) Foreign Application Priority Data

Nov. 18, 2019 (SE) ..... 1951323-3

(51) Int. Cl.

| | |
|---|---|
| ***B02C 7/12*** | (2006.01) |
| ***D21D 1/30*** | (2006.01) |
| ***B02C 7/06*** | (2006.01) |
| ***B02C 7/18*** | (2006.01) |

(52) U.S. Cl.

CPC ..... *B02C 7/12* (2013.01); *B02C 7/06* (2013.01); *B02C 7/188* (2013.01); *D21D 1/30* (2013.01); *D21D 1/303* (2013.01); *D21D 1/306* (2013.01)

(58) Field of Classification Search

CPC .... B02C 7/12; B02C 7/04; B02C 7/06; D21D 1/30; D21D 1/303; D21D 1/306

See application file for complete search history.

(56) References Cited

U.S. PATENT DOCUMENTS 5,042,726 A * 8/1991 Reinhall ..... D21D 1/22 241/261.3
5,704,559 A * 1/1998 Froberg ..... B02C 7/12 241/261.3

(Continued)

FOREIGN PATENT DOCUMENTS

EP 1 302 590 A1 4/2003
RU 2652799 C2 5/2018

(Continued)

OTHER PUBLICATIONS

Russian Search Report and English translation, Application No. 2020133665, dated Mar. 5, 2021, 5 pages.

(Continued)

*Primary Examiner* — Faye Francis
(74) *Attorney, Agent, or Firm* — Foley & Lardner LLP

(57) ABSTRACT

A refiner for refining of lignocellulosic material includes a rotor disc and a stator disc. The rotor disc includes a first refining segment that includes a plurality of first protruding structures for grinding of the lignocellulosic material. Each of the first protruding structures is defined by a first height. The stator disc is arranged opposite the rotor disc and includes a second refining segment that includes a plurality of second protruding structures for grinding of the lignocellulosic material. Each of the second protruding structures being defined by a second height. The first height is at least three times larger than the second height.

15 Claims, 4 Drawing Sheets

(56) References Cited

U.S. PATENT DOCUMENTS

| | | | | |
|---|---|---|---|---|
| 6,024,308 | A * | 2/2000 | Bartels | D21D 1/306 241/261.3 |
| 6,402,071 | B1 * | 6/2002 | Gingras | D21D 1/306 241/261.3 |
| 6,616,078 | B1 * | 9/2003 | Gingras | D21D 1/30 241/261.3 |
| 10,337,145 | B2 | 7/2019 | Gingras | |
| 2004/0173702 | A1 * | 9/2004 | Virving | D21D 1/008 241/261.2 |
| 2017/0073894 | A1 * | 3/2017 | Lindblom | B02C 7/02 |

FOREIGN PATENT DOCUMENTS

| | | | |
|---|---|---|---|
| SU | 1757736 | A1 | 8/1992 |
| WO | WO-01/37998 | A2 | 5/2001 |
| WO | WO-2007/085703 | A1 | 8/2007 |

OTHER PUBLICATIONS

S.N. Vikhrev, "Proizvodstvo drevesnoj massy' iz shhepy'. Raschet rafinerov", Metodicheskie ukazaniya dlya vy'polneniya laboratorny'kh i prakticheskikh rabot po discziplinam: "Teoriya i konstrukcziya tekhnologicheskikh mashin i oborudovaniya", "Proektirovanie i modernizacziya mashin i oborudovaniya CzBP", "Proczessy', tekhnologiya i oborudovanie czellyulozno-bumazhny'kh proizvodstv", "Proczessy', tekhnologiya i oborudovanie drevesno-plitny'kh proizvodstv" dlya studentov ochnoj i zaochnoj formy' obucheniya napravlenij Feb. 3, 2015, Feb. 4, 2015, Ekaterinburg, 2015, 6 pages.

Extended European Search Report, Application No. 20203105.0, dated Mar. 24, 2021, 8 pages.

Russian Office Action, Search Report and English translations, Application No. 2020133665, dated Mar. 5, 2021, 19 pages.

* cited by examiner

REFINER FOR REFINING LIGNOCELLULOSIC MATERIAL AND REFINING SEGMENTS FOR SUCH A REFINER

TECHNICAL FIELD

The proposed technology generally relates to a refiner for refining lignocellulosic material and to refining segments for such a refiner.

Embodiments herein generally relate to refiners and refining segments that provides an improved material flow on the refining discs.

BACKGROUND

A commonly used refiner for refining of, e.g., lignocellulosic material comprises two relatively rotating discs between which the material is refined or defibrated. The pair of relatively rotating discs may in particular comprise one rotating disc, referred to as a rotor, and a static disc, referred to as a stator. These discs are often provided with segments, referred to as refiner segments, whose purpose is to obtain a more efficient refining of the material. Refiner segments are often provided with protruding structures arranged on the active surface of the segment, i.e., the surface of the segment over which the material flows, and they are partly utilized to achieve an efficient refining of the lignocellulosic material. The presence of the protruding structures, which in some refiners are referred to as bars and dams where the bars are often provided in a radial direction and the dams in a direction that is more or less orthogonal to the bars—and often spanning between two adjacent bars, effects the flow of material on the surface of the refining segment. This may create uneven flows displaying turbulence effects which are often unwanted since you want the material to be evenly grinded or refined and uneven flows may cause some material to linger in certain sections leading to a substantial grinding whereas other parts of the material may be swiftly removed from the same section thus experiencing a lower grinding level. Based on this there is a delicate matter to design refining segments so as to achieve both an efficient grinding by means of the protruding structures and a smooth material flow on the efficient surface of the refining surfaces, i.e., the side of the surface facing the disc gap defined as the gap between two opposing refiner discs, e.g., the disc gap arranged between a rotor disc and a stator disc carrying their respective refining segments. It is in the disc gap between the discs that the material is refined or defibrated.

The proposed technology aims to provide refining segments and a refiner comprising such refining segments that display advantageous features when it comes to addressing the simultaneous issues of obtaining efficient grinding by means of the protruding structures as well as a smooth material flow on the refining surfaces.

SUMMARY

It is an object of the proposed technology to provide refining segments for a rotor disc and a stator disc that enables a smoother flow as well as an efficient grinding or refining action on the material.

It is another object of the proposed technology to provide a refiner for refining lignocellulosic material where the refiner comprises a rotor disc and a stator disc equipped with refining segments that enables a smoother flow as well as an efficient grinding or refining action on the material.

These and other objects are met by embodiments of the proposed technology.

According to a first aspect, there is provided a refiner segment pair comprising a first segment and a second segment, where the first segment is configured to be used with a rotor disc for a refiner of lignocellulosic material and the second segment is configured to be used with a stator disc for the refiner of lignocellulosic material. The first and second refining segments comprises protruding structures for grinding the lignocellulosic material. The pair of refiner segments specifies that the height of the protruding structures on the first refining segment is at least three times larger than the height of the protruding structures on the second refiner segment.

According to a second aspect of the proposed technology there is provided a refiner for refining lignocellulosic material. The refiner comprises a rotor disc and an oppositely arranged stator disc. The rotor disc and the stator disc are provided with refining segments that comprises protruding structures for grinding the lignocellulosic material, wherein the height of the protruding structures on the refining segment provided on the rotor disc is at least three times larger than the height of the protruding structures on the refiner segment provided on the stator disc.

Embodiments of the proposed technology enables a smoother material flow on the refining segment as well as an efficient grinding or refining action on the material that flows on the refining segments. Another advantage that follows from the proposed refiner segment design is that the different refining segments, i.e., the refining segment for the rotor and the refining segment for the stator can be manufactured from material having different hardness. This will in turn ensure that the life length of the refining segments can be increased.

Other advantages will be appreciated when reading the detailed description.

BRIEF DESCRIPTION OF THE DRAWINGS

The embodiments, together with further objects and advantages thereof, may best be understood by making reference to the following description taken together with the accompanying drawings, in which.

DETAILED DESCRIPTION

Throughout the drawings, the same reference designations are used for similar or corresponding elements.

Generally, all terms used herein are to be interpreted according to their ordinary meaning in the relevant technical field, unless a different meaning is clearly given and/or is implied from the context in which it is used. All references to a/an/the element, apparatus, component, means, step, etc.

are to be interpreted openly as referring to at least one instance of the element, apparatus, component, means, step, etc., unless explicitly stated otherwise. The steps of any methods disclosed herein do not have to be performed in the exact order disclosed, unless a step is explicitly described as following or preceding another step and/or where it is implicit that a step must follow or precede another step. Any feature of any of the embodiments disclosed herein may be applied to any other embodiment, wherever appropriate. Likewise, any advantage of any of the embodiments may apply to any other embodiments, and vice versa. Other objectives, features and advantages of the enclosed embodiments will be apparent from the following description.

Figure 1:
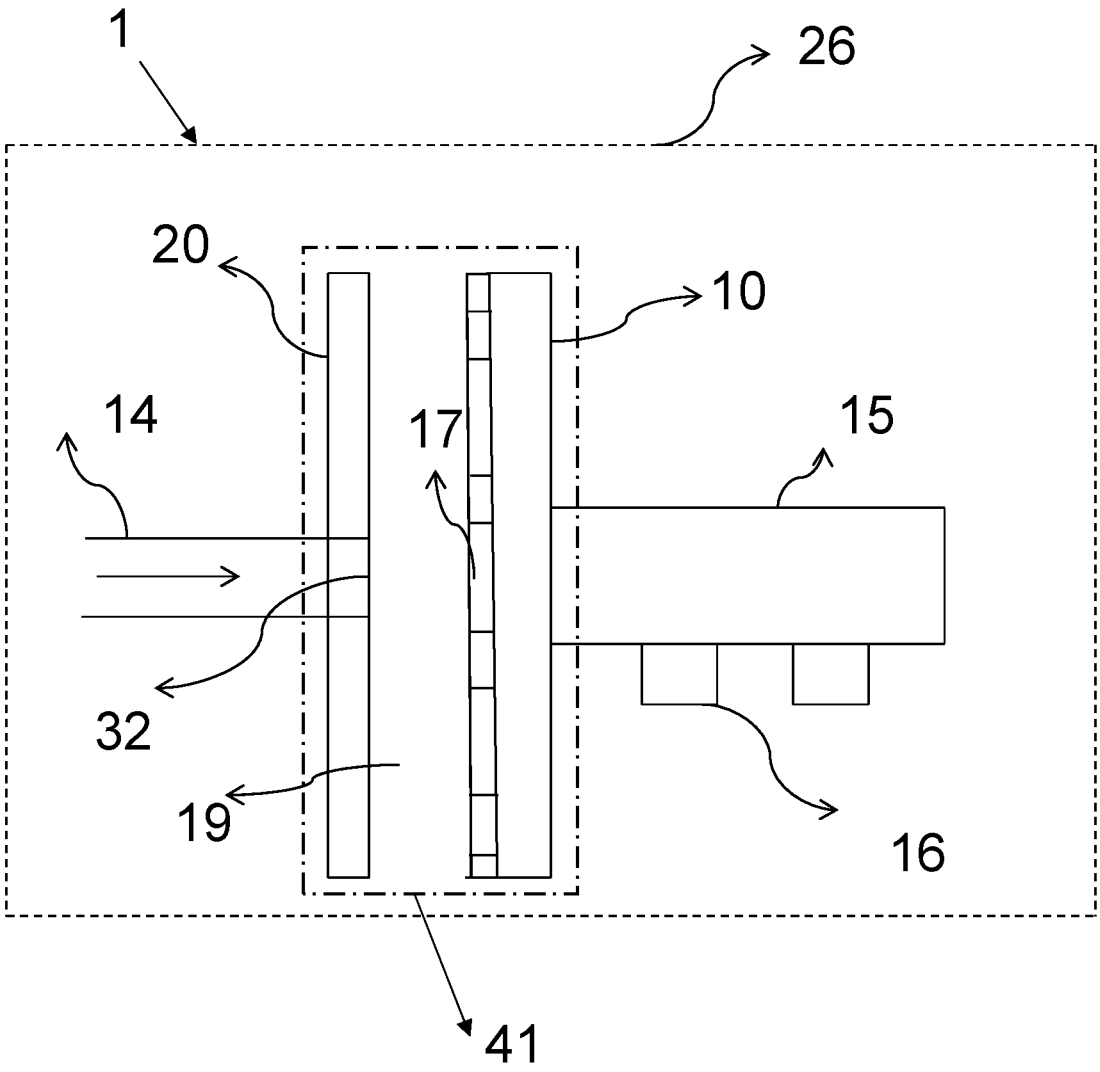
PRIOR ART Fig. 1
FIG. 1 is a schematic depiction of a known refiner in cross-sectional view.

For a better understanding of the proposed technology, it may be useful to begin with a brief overview of a common refiner. To this end reference is made to FIG. 1. FIG. 1 provides a schematic illustration of a refiner that can utilize the proposed technology. Disclosed is a cross-sectional view of a refiner for refining lignocellulosic material, e.g., a pulp refiner, 1 in a cross-sectional view. The arrangement is housed in a housing 26 that represents the outer casing of the refiner device together with all components of the device that is not essential for understanding the present invention. Examples of components not shown are an electrical motor for driving e.g. the rotation shaft, the feeding mechanism for the lignocellulosic material etc. Inside a second housing 41 a rotor disc 10, also referred to as a rotor refiner disc, and a stator disc 20, also referred to as a stator refiner disc, is linearly aligned along a shaft. The rotor disc 10 is attached to a rotation shaft 15 arranged on bearings 16. The rotation shaft 15 is connected to a motor, not shown, that rotates the shaft 15, and thus the rotor disc 10. The stator disc 20 facing the rotor disc 10 can be provided with a centrally located through hole 32 that extends between a feeding channel 14 for lignocellulosic material and a refining gap 19. The rotor 10 can in certain embodiments be provided with a center plate 17 having a surface facing the incoming flow of lignocellulosic material. The surface of the center plate 17 can be provided with structures that will direct the lignocellulosic material outwards. The center plate 17 are arranged closer to the center of the disc than the refining segment. The rotor disc 10 and the stator disc 20 are often provided with protruding structures that enable steering and grinding of the lignocellulosic material. These refiner segments can in addition be provided with bars and dams. The center plate 17 are arranged closer to the center of the disc than the refining segment, that is, the center plate is arranged inside the refining segment in a radial direction having origin in the center of the disc. Note that certain discs may not have a center plate but rather a central area that is arranged inside the refining segments.

During use, lignocellulosic material such as wood chips or prepared wood, e.g., pulp, will be fed by means of a feeding mechanism, not shown, through the feeding channel 14. The material will pass through the hole 32 in the stator disc 20 and enter a gap 19. The gap 19 is essentially defined by the open area between the rotor disc 10 and the stator disc 20 and this area can be quite small during operation. The lignocellulosic material flowing into the gap 19 will be incident on the center plate 17 on the rotor 30. The center plate 17 acts to steer the lignocellulosic material out towards the refiner segments on the rotor and/stator.

Having described in detail a general refiner that can utilize the proposed technology, we will proceed and describe in detail a particular rotor and stator design that is relevant for the proposed technology.

Figure 2:
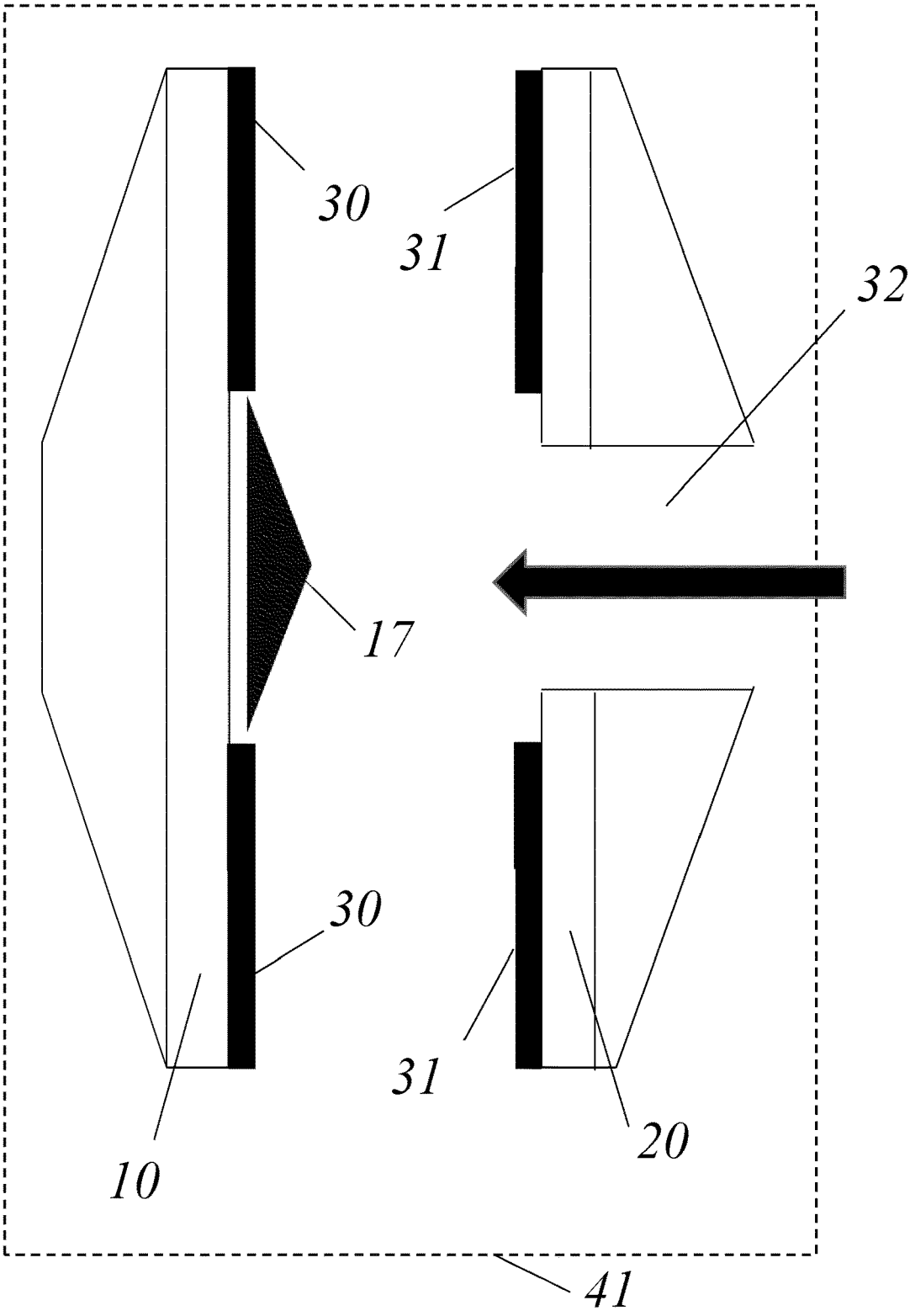
PRIOR ART Fig. 2
FIG. 2 is a schematic cross-sectional depiction of a stator disc-rotor disc arrangement in a refiner.

In order to provide a more detailed description of a rotor-stator arrangement in which the proposed technology may be used reference is now made to FIG. 2. FIG. 2 illustrates a cross-sectional side view of a rotor—stator arrangement housed in a housing 41 in a refiner as e.g., described above. Shown is a rotor that is arranged to rotate around a rotation shaft. The rotor is provided, on the surface facing the stator, with a rotor disc 10 comprising a refiner segment 30. The stator is provided, on the surface facing the rotor, with a stator disc 20 comprising a refiner segment 31. The rotor and stator discs 10; 20 may in certain versions of a refiner be referred to as a segment holders since one of the purposes of the refiner discs are to carry the refiner segments 30; 31. Also illustrated in FIG. 2 is an inlet 32 for the lignocellulosic material subject to refining. The inlet 32 is arranged in the central area of the stator. Arranged in the center area of the refiner disc on the rotor side, opposing the inlet 32, is a center plate 17. The purpose of the center plate 17, which was described above with reference to FIG. 1, is to distribute material that falls in from the inlet 32 towards the outer sections of the refiner disc. That is, the center plate 17 acts to distribute the material towards the refiner segments arranged on the refiner discs. The center plate may in certain versions of a refiner be optional.

Figure 3A:
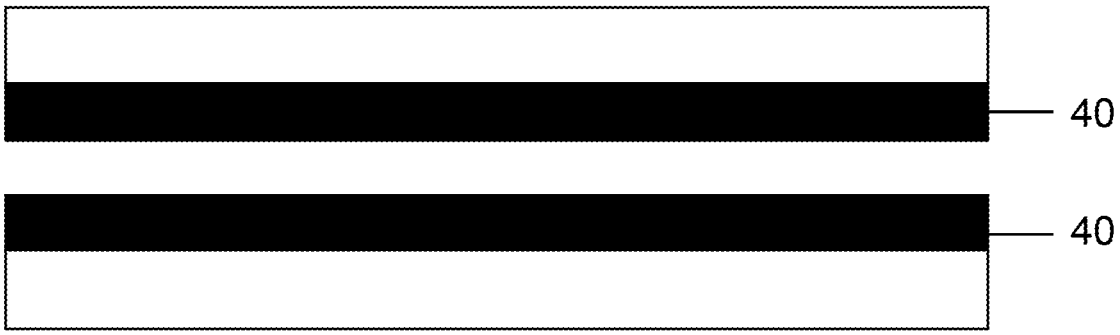
FIG. 3*a* is a schematic cross-sectional side view of a refiner segment pair according to the proposed technology. The refiner segment pair is arranged so that their refining surfaces are facing each other.

A particularly beneficial feature for a refiner is to have a refiner segment design that simultaneously provide the possibility for a smooth material flow on the refiner segment surfaces and an efficient refining action. The proposed technology provides refiner segments displaying such features. Reference is now made to FIG. 3*a* which illustrates two opposing refining discs, a rotor disc 10 and a stator disc 20. The discs 10; 20 are provided with protruding structures, e.g., bars 40. The inventor has realized that the protruding structures 40 on the rotor disc and stator disc can be provided so that the structures 40 on the rotor disc have a different height compared to the protruding structures provided on the stator disc segment. The height of a protruding structure is defined as the extension of the protruding structures in the direction of the normal of the protruding structures, i.e., in the direction from the surface of the refining segment towards the intended disc gap between the rotor side segment and stator disc segment when in use in a refiner. This provision of different heights will ensure that there are different volumes on the rotor side and stator side for the transport of vapor, commonly produced when refining lignocellulosic material, and/or refining material. Steam should preferably travel along the stator disc surface while the mass or lignocellulosic material preferably should travel along the rotor disc surface. A positive consequence of the proposed technology is that the material to be refined will have more volume to occupy on the rotor side and is therefore allowed to mainly flow along the rotor side segment while the steam is allowed to flow on the stator side segment, thus ensuring reduced interaction between steam and the material to be refined. Since the stator disc segment are provided with lower protruding structures and thus carries a lower fraction of the material flow it will be possible to provide the protruding structures in a more fine-structured pattern without substantially affecting the overall material flow. This fine structured pattern will in turn yield a substantially higher number of edges, something that instead will improve the distribution of the material and enable an efficient grinding of the same.

Due to the relatively low height of the protruding structures on the stator disc segment it will be possible to provide the refining segment of the stator disc in a harder material which will increase the effective life span of the stator refining segment. The inventor has realized that the relative low height of the protruding structures on the refining segments on the stator side enable the use of a harder material as construction material for those refining segments. By realizing that the provision of higher protruding structures of a hard material leads to a brittleness against impact it will be possible to use a harder material when the height of the protruding structures has been reduced. That is to say, the proposed technology enables the use of a relatively harder construction material on the stator side as compared to the rotor side due to the relatively lower height extension of the corresponding protruding structures, e.g., the bars on the stator side refining segment.

The inventor has found that the provision of protruding structures with different heights on the stator side relative the rotor side yields large improvements with regard to the material transport volume when the height of the protruding structures on the rotor side segment is at least three times higher than the height on the stator disc segment. In what follows we will provide a detailed description of various embodiments of the proposed technology. The proposed technology can be used in connection to a refiner design as described earlier.

A first aspect of the proposed technology provides a refiner for refining of lignocellulosic material. This refiner is equipped with refiner segments for the rotor disc and stator disc according to a particular design. That is, the proposed technology provides a refiner 1 for refining lignocellulosic material. The refiner comprises a rotor disc 10 and an oppositely arranged stator disc 20. The rotor disc 10 and the stator disc 20 are provided with refining segments 30; 31 that comprises protruding structures 40 for grinding, or refining, the lignocellulosic material. The refiner displays refining segments 30; 31 where the height of the protruding structures 40 on the refining segment 30 provided on the rotor disc 10 is at least three times larger than the height of the protruding structures 40 on the refiner segment 31 provided on the stator disc 20.

Figure 3B:
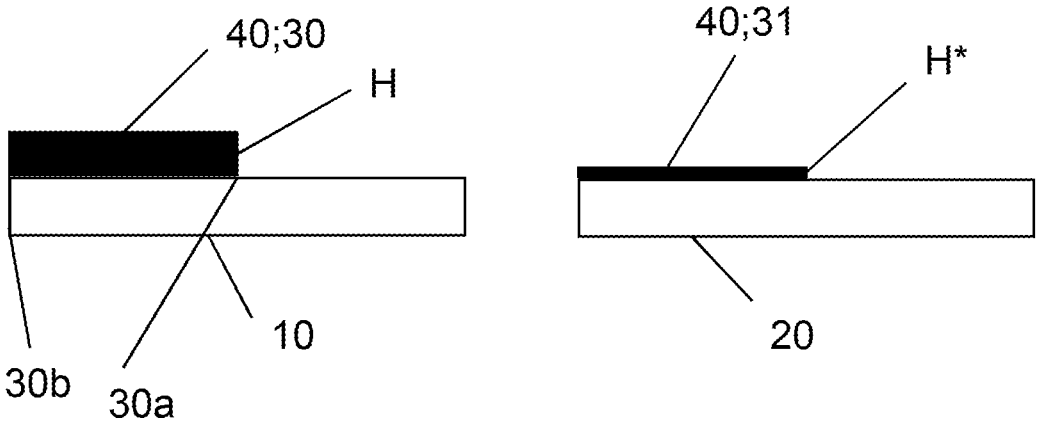
FIG. 3*b* is a schematic cross-sectional side view of a refiner segment pair according to the proposed technology. The refiner segment pair are arranged side by side.

As was mentioned earlier, the differing heights of the protruding structures on the rotor side segment and the stator disc segment enables an improvement with regard to the material transport when the height of the protruding structures on the rotor side segment is at least three times higher than the height on the stator disc segment. This height difference yields a transport volume difference on the different sides so that the material to be refined have three times more volume to travel in on the rotor side when compared to the stator side. Reference is now made to FIG. 3*b* which discloses a schematic cross-sectional side view of a refiner segment pair for a refiner according to the proposed technology. The refiner segment pair are arranged side by side. The protruding structures 40; 30 on the rotor disc segment 10 is shown as having a height H while protruding structures 40; 31 on the stator disc segment 20 is shown as having a height H*, the ratio between H and H* should be at least three according to the proposed structure, i.e., $H/H^* \geq 3$. The fact that the bulk of the material flow will be on the rotor side in the proposed technology makes it possible to design the stator disc segment with certain features without affecting the overall material flow in a negative fashion. Specific stator disc segments will be described in detail later in this disclosure.

Some of the embodiments contemplated herein will now be described in more detail. more fully with reference to the accompanying drawings. Other embodiments, however, are contained within the scope of the subject matter disclosed herein, the disclosed subject matter should not be construed as limited to only the embodiments set forth herein; rather, these embodiments are provided by way of example to convey the scope of the subject matter to those skilled in the art.

A particular embodiment of the proposed technology provides a refiner 1 wherein the refining segment 30 provided on the rotor disc 10 is made from a material that is harder than the material of the refining segment 31 of the stator disc 20.

The fact that the rotor side segment and stator disc segment are provided with protruding structures with different heights ensures that the stator disc segment can be manufactured from a harder material than the material of the rotor disc segment. This follows from the inventor's insight that protruding structures with a pronounced extension made from harder material are more prone to brittleness. By reducing the heights of the protruding structures, it will be possible to use a harder material without affecting the brittleness of the refining segment negatively. The hardness of the material may for example be decided based on a Rockwell scale. Rockwell scale is a hardness scale based on indentation hardness of a material. The Rockwell test is a well-known test where the depth of penetration of an indenter under a large load is measured and compared to the penetration made by a smaller preload. The Rockwell test comes in different scales, for example HRA, HRB, HRC and yields dimensionless parameters, often denoted N, as a hardness characterizer. The rotor side refining segment should preferable have an N of at least 57-58 and even more preferable an N above 60.

A particular version of the above embodiment provides a refiner 1 wherein the refining segment 30 provided on the rotor disc 10 is made from a material selected from the group consisting of: iron, steel or stainless steel, and the refining segment 31 provided on the stator disc 20 is made from a material comprising diamond.

Another embodiment of the proposed technology provides a refiner 1 wherein the protruding structures 40 of at least the refining segment 30 provided on the rotor disc comprises bars extending radially from an inner periphery 30*a* of the refining segment 30 to an outer periphery 30*b* of the refining segment. See, e.g., FIG. 3*a*.

Even though the bars are intended to extend radially from an inner periphery 30*a* of the refining segment 30 to an outer periphery 30*b* of the refining segment they may have a curved shape to improve material flow characteristics.

Still another embodiment of the proposed technology provides a refiner wherein each of the bars on the refining segment 31 provided on the stator disc 20 have a width lying in the interval [0.5 mm, 2.5 mm], preferably in the interval [0.5 mm, 2.2 mm], and even more preferable in the interval [0.5 mm, 2.0 mm] and each of the bars on the refining segment 30 provided on the rotor disc 10 have a width lying in the interval [1.0 mm, 5 mm], preferably in the interval [1.4 mm, 4.5 mm], and even more preferable in the interval [1.6 mm, 4 mm].

Still another embodiment of the proposed technology provides a refiner wherein the distance that spans between radially extending adjacent bars lies in the interval [0.1 cm, 1.0 cm]. The distance should preferably lie in the interval [0.1 cm, 0.8 cm], and even more preferable in the interval [0.1 cm, 0.4 cm]. The distances in this embodiment is equally relevant for the refining segments for the rotor disc and the refining segments for the stator disc.

By way of example, the proposed technology provides a refiner wherein the protruding structures 40 on the refining segment 31 provided on the stator disc 20 comprises protruding structures having the shape of pyramids or stubs.

These alternative shapes and forms for the protruding structures are also enabled by the mechanisms of the proposed technology. The protruding structures on the stator side may for example be made from a harder material than the bulk material of the refiner segment. That is, it may be a composite refiner segment comprising a bulk material such as iron or steel or stainless steel provided with protruding structures of a second and harder material, e.g., diamond, bound to the bulk material. The refining segment may however also be made as a single material piece where the protruding structures are milled from the surface of the bulk material. The refining segment may also be cast to a single material piece displaying protruding structures with particular shapes.

Having described various embodiments of the proposed refiner, we will now proceed and describe various versions of a second aspect of the proposed technology, namely a refiner segment pair 30; 31 that can be used with an existing refiner. That is, the refiner segment pair can be provided as separate equipment for a known refiner. The cooperating features of the refiner segment pair will ensure that the refining action yields both a smooth flow on the surface as well as an efficient grinding action. The specific advantages associated with the refiner segments have been at least partly described above and will not be repeated in the section below.

A refining segment in the proposed refining segment pair may be provided in the shape of a segment to be attached to a refiner disc, i.e., to a rotor disc or a stator disc. A refining segment may be provided in the shape of a circle, optionally with a removed central area, or in the shape of a circle sector. A specific disc in the shape of a rotor disc or a stator disc may thus be provided with a number of refiner segments whereby it will either be completely covered by refining segments or partially covered. The refining disc may thus also be referred to as a segment holder. The refining segment may however also be provided in the form of a complete integrated disc, thus forming part of, or defining, the refining disc in itself. In this case the refining segment and the refining disc form an integrated structure that can be attached to a rotor or a stator. A refining segment pair may refer to a first set of refining segments, comprising at least one refining segment, intended to be used with the rotor disc and a corresponding second set of refining segments, comprising at least one refining segment, intended to be used with the stator disc. The different sets of refining segments are provided with features to be described below.

The refiner segment pair to be described below are preferably made as a single piece to reduce the risk that attached parts come off during the refining action. Such loose parts may damage the refining segment surface and this should preferably be avoided. There are however some scenarios where a composite refining segment can be useful, for example by providing protruding structures of a hard material on the stator disc segment.

Figure 4:
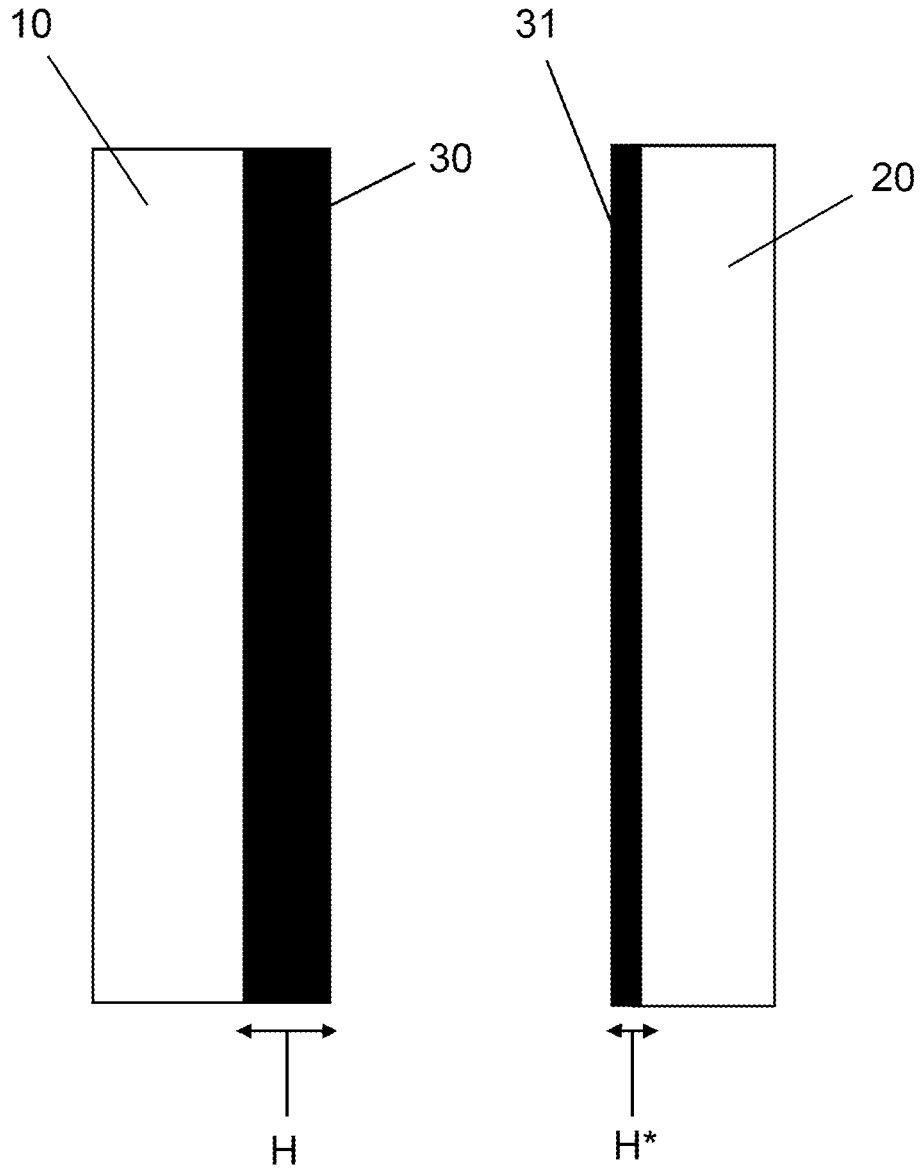
FIG. 4 is a schematic cross-sectional side view of a refiner segment pair according to the proposed technology. The refiner segment pair is arranged so that their refining surfaces are facing each other.

According to the second aspect, the proposed technology provides a refiner segment pair that comprises a first segment 30 and a second segment 31. The first segment is configured to be used with a rotor disc for a refiner of lignocellulosic material and the second segment is configured to be used with a stator disc for the refiner of lignocellulosic material. The first and second refining segments 30; 31 comprises protruding structures 40 for grinding of the lignocellulosic material, where the height of the protruding structures 40 on the first refining segment 30 is at least three times larger than the height of the protruding structures 40 on the second refiner segment 31. A refiner segment pair having these features are schematically depicted in FIG. 3*b*, where they lie side to side, and in FIG. 4 where they are opposing each other with a gap between them. This gap is the disc gap and is the area in the refiner where the material is grinded or refined.

A particular embodiment of the proposed technology provides a refiner segment pair wherein the refining segment 30 configured to be provided on the rotor disc 10 is made from a material that is harder than the material of the refining segment 31 that is configured to be used with the stator disc 20.

Another embodiment of the proposed technology provides a refiner segment pair wherein the protruding structures 40 of at least the refining segment 30 configured to be used with the rotor disc 10 comprises bars extending radially from an inner periphery 30*a* of the refining segment 30 to an outer periphery 30*b* of the refining segment.

Still another embodiment of the proposed technology provides a refiner segment pair wherein each of the bars have a width lying in the interval [0.1 cm, 0.8 cm]. The width should preferably lie in the interval [0.1 cm, 0.6 cm], and even more preferable in the interval [0.1 cm, 0.3 cm].

Still another embodiment of the proposed technology provides a refiner segment pair wherein each of the bars on refining segment 31 to be used with the stator disc have a width lying in the interval [0.5 mm, 2.5 mm], preferably in the interval [0.5 mm, 2.2 mm], and even more preferable in the interval [0.5 mm, 2.0 mm] and each of the bars on the refining segment 30 to be used with the rotor disc have a width lying in the interval [1.0 mm, 5 mm], preferably in the interval [1.4 mm, 4.5 mm], and even more preferable in the interval [1.6 mm, 4 mm].

Yet another embodiment of the proposed technology provides a refiner wherein the distance that spans between radially extending adjacent bars lies in the interval [0.1 cm, 1.0 cm]. The distance should preferably lie in the interval [0.1 cm, 0.8 cm], and even more preferable in the interval [0.1 cm, 0.4 cm].

By way of example, the proposed technology also provides a refiner segment pair wherein the protruding structures 40 on the refining segment 31 that is configured to be used with the stator disc 20 comprises protruding structures having the shape of pyramids or stubs. These pyramids and stubs may for example be made from a harder material than the bulk material of the rotor disc segment and/or the bulk material of the stator disc segment.

The proposed technology also provides a use of a refiner segment pair according to the above in a refiner 1 for refining of lignocellulosic material.

The invention claimed is:

1. A refiner for refining of lignocellulosic material, the refiner comprising:

a rotor disc comprising a first refining segment that includes a plurality of first protruding structures for grinding of the lignocellulosic material, each of the first protruding structures being defined by a first height; and a stator disc arranged opposite the rotor disc, the stator disc comprising a second refining segment that includes a plurality of second protruding structures for grinding of the lignocellulosic material, each of the second protruding structures being defined by a second height;

wherein the first height is at least three times larger than the second height; and wherein the first protruding structures are separated from the second protruding structures by a disc gap;

wherein the refiner is configured to facilitate refining of the lignocellulosic material in the disc gap;

wherein the first refining segment is made from a first material; and wherein the second refining segment is made from a second material, the second material being harder than the first material.

2. The refiner of claim 1, wherein the first protruding structures comprise a plurality of first bars extending radially from an inner periphery of the first refining segment to an outer periphery of the first refining segment.

3. The refiner of claim 2, wherein each of the first bars is separated from another of the first bars by a distance that is between 0.1 centimeters (cm) and 1 cm.

4. The refiner of claim 2, wherein:

the second protruding structures comprise a plurality of second bars extending radially from an inner periphery of the second refining segment to an outer periphery of the second refining segment;

each of the second bars has a width of 0.5 millimeters (mm) to 2.5 mm; and each of the first bars has a width of 1 mm to 5 mm.

5. The refiner of claim 4, wherein each of the first bars is separated from another of the first bars by a distance that is between 0.1 centimeters (cm) and 1 cm.

6. The refiner of claim 1, wherein at least some of the second protruding structures are pyramids or stubs.

7. The refiner of claim 1, wherein the first protruding structures comprise a plurality of first bars extending radially from an inner periphery of the first refining segment to an outer periphery of the first refining segment.

8. A refiner segment pair comprising:

a first segment configured to be used with a rotor disc for a refiner of a lignocellulosic material, the first segment comprising a plurality of first protruding structures for grinding of the lignocellulosic material, each of the first protruding structures defined by a first height; and a second segment configured to be used with a stator disc for the refiner of lignocellulosic material, the second segment comprising a plurality of second protruding structures for grinding of the lignocellulosic material, each of the second protruding structures being defined by a second height;

wherein the first height is at least three times larger than the second height;

where the first refining segment is made from a first material; and wherein the second refining segment is made from a second material, the second material being harder than the first material.

9. The refiner segment pair of claim 8, wherein the first protruding structures comprise a plurality of first bars extending radially from an inner periphery of the first segment to an outer periphery of the first segment.

10. The refiner segment pair of claim 9, wherein:

the second protruding structures comprise a plurality of second bars extending radially from an inner periphery of the second segment to an outer periphery of the second segment;

each of the second bars has a width of 0.5 millimeters (mm) to 2.5 mm; and each of the first bars has a width of 1 mm to 5 mm.

11. The refiner segment pair of claim 10, wherein each of the first bars is separated from another of the first bars by a distance that is between 0.1 centimeters (cm) and 1 cm.

12. The refiner segment pair of claim 9, wherein each of the first bars is separated from another of the first bars by a distance that is between 0.1 centimeters (cm) and 1 cm.

13. The refiner segment pair of claim 8, wherein at least some of the second protruding structures are pyramids or stubs.

14. The refiner segment pair of claim 8, wherein the first protruding structures comprise a plurality of first bars extending radially from an inner periphery of the first segment to an outer periphery of the first segment.

15. A refiner for refining of lignocellulosic material, the refiner comprising:

a rotor disc comprising a first refining segment that includes a plurality of first protruding structures for grinding of the lignocellulosic material, each of the first protruding structures being defined by a first height being uniform from an inner radial surface of a corresponding one of the first protruding structures to an outer radial surface of the corresponding one of the first protruding structures; and a stator disc arranged opposite the rotor disc, the stator disc comprising a second refining segment that includes a plurality of second protruding structures for grinding of the lignocellulosic material, each of the second protruding structures being defined by a second height being uniform from an inner radial surface of a corresponding one of the second protruding structures to an outer radial surface of the corresponding one of the second protruding structures;

wherein the first height is at least three times larger than the second height; and wherein the first protruding structures are separated from the second protruding structures by a disc gap;

wherein the refiner is configured to facilitate refining of the lignocellulosic material in the disc gap;

wherein the first refining segment is made from a first material; and wherein the second refining segment is made from a second material, the second material being harder than the first material.

* * * * *